United States Patent [19]

Ueda et al.

[11] 3,988,807

[45] Nov. 2, 1976

[54] ROTARY DRAFTING APPARATUS HAVING IMPROVED TOOTH STRUCTURE

[75] Inventors: Shigekazu Ueda, Kasugai; Masakazu Shino, Yamatotakada, both of Japan

[73] Assignees: Chubu Seiko Kabushiki Kaisha, Kasugai; Masakazu Shino, Yamatotakada, both of Japan

[22] Filed: Jan. 13, 1975

[21] Appl. No.: 540,683

[30] Foreign Application Priority Data

Jan. 16, 1974 Japan ..... 49-7874[U]
Jan. 16, 1974 Japan ..... 49-7875[U]

[52] U.S. Cl. ..... 19/258; 19/128
[51] Int. Cl.² ..... D01H 5/74
[58] Field of Search ..... 19/236, 258, 65 A, 128, 19/127

[56] References Cited

UNITED STATES PATENTS

| | | | |
|---|---|---|---|
| 307,331 | 10/1884 | Ramus | 19/128 X |
| 1,633,029 | 6/1927 | Laurency | 19/128 |
| 2,761,179 | 9/1956 | Lepoutre | 19/258 |
| 3,611,507 | 10/1971 | Ootsuki et al. | 19/258 X |

FOREIGN PATENTS OR APPLICATIONS

| | | | |
|---|---|---|---|
| 14,191 | 1903 | United Kingdom | 19/236 |

OTHER PUBLICATIONS

Japanese Patent Publication (Nakagawa) No. 46–36892 Published Oct. 29, 1971.

*Primary Examiner*—Dorsey Newton

[57] ABSTRACT

Herein disclosed is an improved tooth structure adapted for those paired control rollers of a rotary drafting apparatus, which are positioned adjacent to the paired front or drafting rollers of the drafting apparatus. The tooth structure has each of its teeth so contoured that the angle contained in the back or trailing side between the front or leading-side face of the tooth and the tangent, which is taken in the backward direction from the leading edge of the particular tooth to the dedendum circle of the control roller where the tooth is formed, is preset equal to or larger than a right angle.

1 Claim, 6 Drawing Figures

ROTARY DRAFTING APPARATUS HAVING IMPROVED TOOTH STRUCTURE

BACKGROUND OF THE INVENTION

1. Field of the Invention:

The present invention relates to a rotary drafting apparatus for use in a spinning machine, and more particularly to a tooth structure adapted for control rollers of the drafting apparatus of the above type.

2. Description of the Prior Art:

In order to accomplish combing of silver, it has been put into practice to interpose control rollers between a pair of back or feed rollers and a pair of front or drafting rollers. Each of these control rollers is formed with a number of needles or teeth on its circumference. The control rollers thus formed are grouped into a few of vertical pairs, each of which is composed of top and bottom rollers, and the resultant pairs are arranged in cascade for the desired combing treatment. In the known control rollers, however, the silver is liable to be partially seized and carried back upstream by their needles or teeth, thus making it impossible to expect smooth and efficient combing of the silver. Such seizure of fiber by the teeth will invite unevenness in the thickness of the silver and accordingly substantial reduction in overall efficiency of the drafting apparatus.

SUMMARY OF THE INVENTION

It is therefore a major object of the present invention to provide a tooth structure adapted for control rollers of a rotary drafting apparatus, which structure can eliminate the drawbacks concomitant with the conventional drafting apparatus.

Another object of the invention is to provide a rotary drafting apparatus having the improved tooth structure as above.

According to a major feature of the present invention, there is provided a tooth structure adapted at least for that pair of control rollers of a rotary drafting apparatus, which is positioned closest to a pair of front rollers of the drafting apparatus. The tooth structure has each of its teeth so contoured that the angle of the trailing side of rotation contained between the tooth face of the leading side and the tangent, which is taken toward the trailing side from the leading edge of the particular tooth to the dedendum circle of the control roller where the tooth is formed, is predetermined equal to or larger than a right angle.

BRIEF DESCRIPTION OF THE DRAWINGS

Other objects and advantages of the present invention will become apparent from the following description taken in conjunction with the accompanying drawings, in which.

DESCRIPTION OF THE PREFERRED EMBODIMENT

Figure 1:
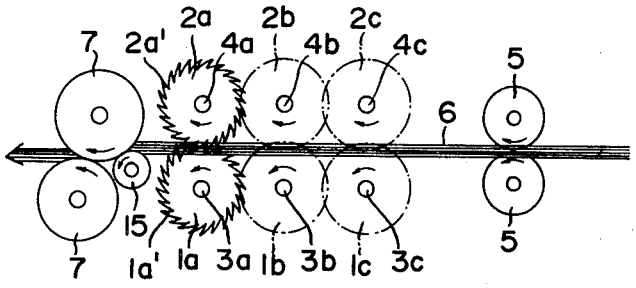
FIG. 1 a diagrammatical side elevation showing one general arrangement of rollers of a rotary drafting apparatus.
Figure 2:
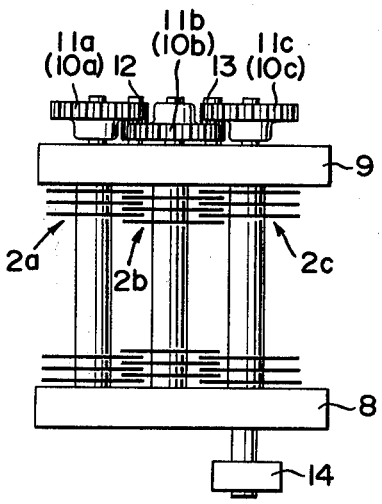
FIG. 2 is a diagrammatical top plan view showing the arrangement of control rollers of the drafting apparatus of FIG. 1.

One embodiment of the present invention will now be made with reference to the accompanying drawings. Designated at reference numerals 1a, 1b and 1c in FIGS. 1 and 2 are bottom control rollers which are rotatably supported by their respective shafts 3*a*, 3*b* and 3*c*. Designated at numerals 2*a*, 2*b* and 2*c* are, on the other hand, top control rollers which are also rotatably supported by their respective shafts 4*a*, 4*b* and 4*c* and which are made coactive with the bottom control rollers 1*a*, 1*b* and 1*c*. These control rollers are formed with a number of teeth on their circumferences and are grouped into three coactive pairs 1*a*, and 2*a*, 1*b* and 2*b*, and 1*c* and 2*c*. These three pairs are interposed in cascade between a pair of back or feed rollers 5 and a pair of front or drafting rollers 7, so that sliver 6 fed from the back rollers 5 may be carried to the front rollers 7 after having been combed by the teeth of the top and bottom control rollers. The shafts of the control rollers have their both ends rotatably supported by stands 8 and 9, as better seen from FIG. 2. A gear mechanism is attached to the shaft ends of one side, while a drive mechanism is attached to one of the shaft ends of the other side so as to apply a drive force to the gear mechanism and accordingly to the control rollers. As apparent from FIG. 2, the gear mechanism comprises as customary gears 10*a*, 10*b* and 10*c*, which are fixed to the respective shaft ends of the bottom control rollers, gears 11a, 11b and 11c, which are also fixed to the respective shaft ends of the top control rollers, and two intermediate gears 12 and 13 which are interposed between the gears 10*a* and 10*b* (or 11*a* and 11*b*) and between the gears 10*b* and 10*c* (or 11*b* and 11*c*). The paired gears 10*a* and 11*a*, 10*b* and 11*b*, and 10*c* and 11*c* are made to mesh with each other. Thus, the drive force established in a suitable prime mover is transmitted to a transmission gear 14 which is fixed to the opposite end of the bottom control roller 1c. The drive force is then transmitted to the gear 10c of the same shaft and further to the gears 10*c* – 13 – 10*b* – 12 – 10*a* in this order. The top control rollers 2a, 2b and 2c are driven by the force which is transmitted to the gears 10*c* – 11*c*, 10*b* – 11*b*, and 10*a* – 11*a*, respectively, in this order. As easily understood, it is a current practice that the six control rollers have substantially the same circumferential velocity as the paired feed rollers 5 while a nip roller 15 has a circumferential velocity several times larger than that of the same velocity.

Figure 3:
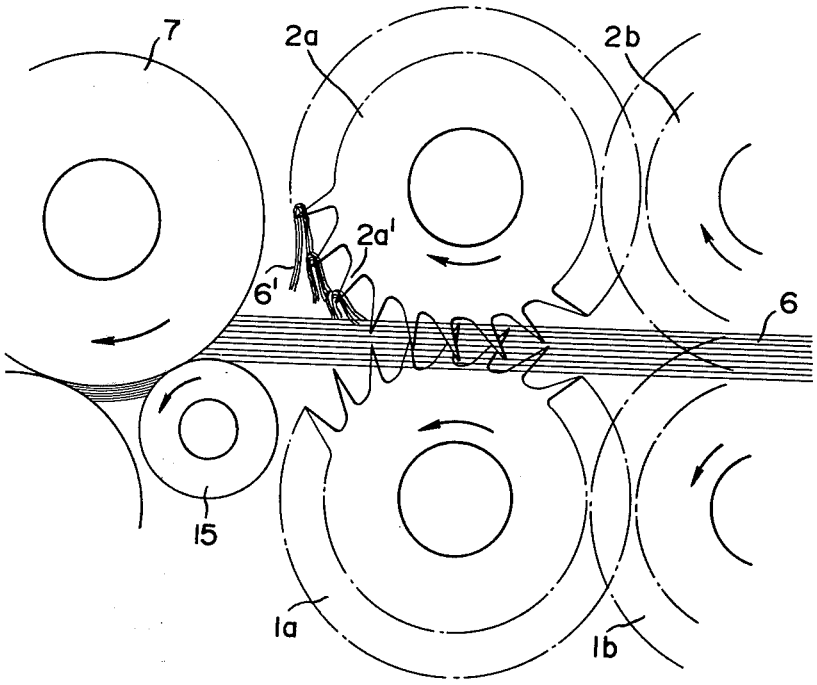
FIG.3 PRIOR ART
FIG. 3 is an enlarged explanatory view showing the condition in which fiber is seized by the teeth of the control rollers of FIG. 2.

Turning now to FIG. 3, it is frequently encountered in the conventional drafting apparatus that a portion 6′ of the sliver 6 having left the paired control rollers 1a and 2*a* is seized and carried back upstream by the teeth 2*a′* of the control roller 2a before it reaches the paired drafting rollers 7. The frequency of such seizure is found the most during or after the combing process to be carried out by the control rollers.

Figure 4:
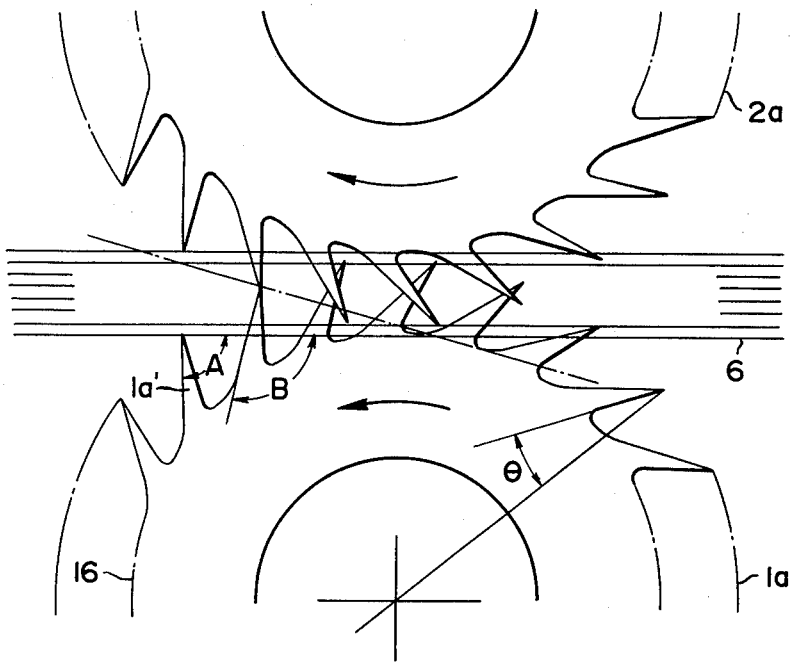
FIG. 4 is also an enlarged explanatory view showing a tooth structure for use in the control rollers according to the present invention.
Figure 5:
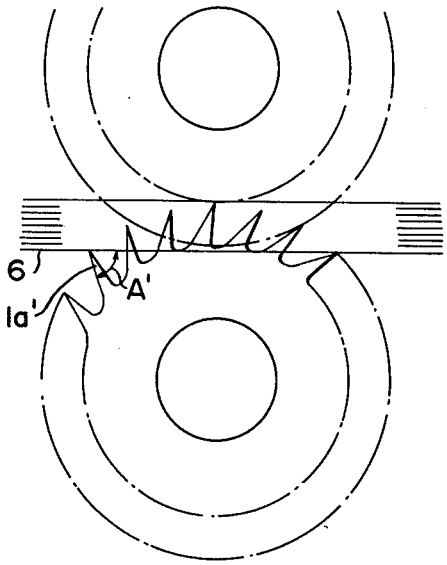
FIG. 5 PRIOR ART
FIG. 5 is similar to FIG. 4 but shows a tooth structure as used in the conventional control rollers.

With close reference to FIGS. 4 and 5 showing the instance at which the tooth 1*a′* leaves the sliver 6, if the inside or trailing-side angle A′ contained between the leading-side face of the tooth 1*a′* and the flow line of the sliver 6 is at such a small value as shown in FIG. 5, then it is more liable that the fiber of the sliver 6 is seized and carried back upstream i.e. upward or downward by the tooth 1*a*'. If, on the contrary, the angle A defined similarly is at such a larger value as shown in FIG. 4, then the undesirable phenomenon is the least liable. The experiments conducted by us, the Inventors, have revealed that such seizure can be perfectly eliminated for the particular angle A larger than 90° and can be materially reduced for the angle A slightly smaller than the specified value. It is also found that the angle A contained between the leading-side face of the teeth 1*a*' and the flow line of the sliver 6 is varied with the rotation of the control roller 1a and takes its minimum when the tooth 1*a*' leaves the sliver 6. More specifically, when the tooth is assumed to be positioned next to the tooth 1*a*' in FIG. 4, the angle A is changed into an angle B which is apparently larger than the former angle A. From these findings, it can be concluded that if the front face of the tooth just leaving the sliver has an angle substantially equal to or larger than 90° the particular tooth will not seize the sliver 6 at any position of its rotation.

A further consideration will now be made on the flow or behaviour of the sliver 6 with reference to FIG. 4. The sliver 6 will proceed substantially from the top plane of the dedendum circle 16 of the bottom control roller 1a to the top plane of the nip roller 15. This is because the current practice adopts such a design that the dedendum of the teeth of the bottom control roller 1a is set at a level substantially the same as or slightly lower than the top plane of the nip roller 15. This design results in that the outermost flow line of the sliver coincides substantially with the tangent to the dedendum circle of the control roller and accordingly in that the angle A between the front face of the tooth 1*a*' and the flow line of the sliver 6 is coincide with the angle formed between the front side of any tooth and the tangent, which is taken toward the trailing side from the leading edge of the particular tooth to the dedendum circle 16 of the control roller. In other words, the controur of the front face of the tooth 1*a*' is required to have an inclination equal to or larger than a right angle with respect to the tangent which is taken from the leading edge of the tooth 1a' to the dedendum 16.

Although the above explanation has been limited to the bottom control roller 1a, it should be understood that an analogy can be applied to the top control roller 2*a*. Here, the angle $\theta$ of inclination of the back or trailing-side face of the tooth 1*a*' is usually preset at a value 0° to 20°, and the thickness of the flank of the tooth can be enough to provide a sufficiently strong tooth structure.

Figure 6:
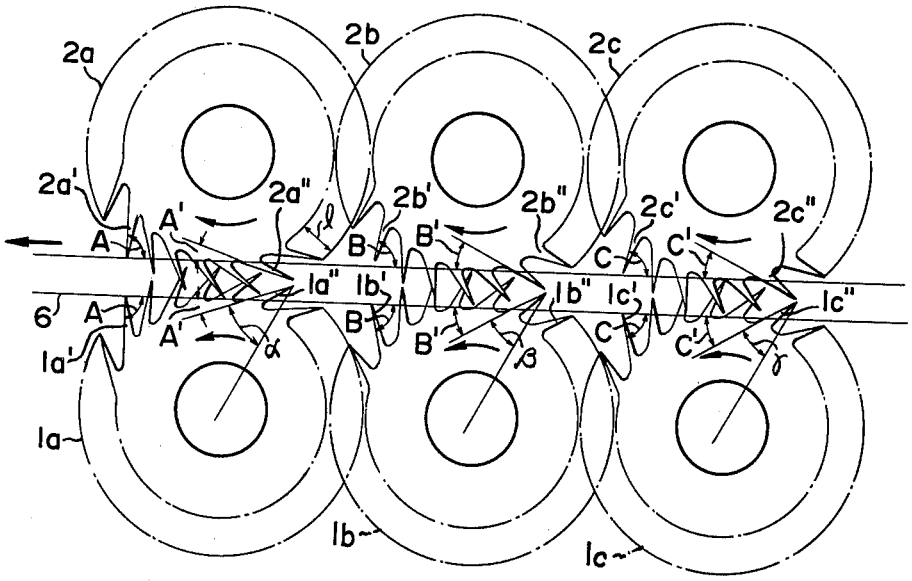
FIG. 6 is an enlarged side elevation explaining the contour of the teeth having the structure according to the present invention.

According to the present invention, the paired control rollers 1*a* and 2*a*, which are positioned closest to the paired front rollers 7, are so designed as to have the inside angle A of inclination larger than those of the remaining control rollers 1*b*, 2*b*, 1*c* and 2*c*. The tooth structure thus designed can prevent the fiber just leaving the control roller assembly from being seized and carried back by the teeth of the downstream pair of control rollers 1*a* and 2*a*. This prominent advantage of the present invention will now be described in more detail with reference to FIG. 6. The tooth structure for the paired control rollers 1*a* and 2*a*, which are positioned closest to the front rollers 7, is so designed that the angle A between the front face of the tooth 1*a*' or 2*a*' just leaving the sliver 6 and the flow line of the sliver is substantially equal to or larger than a right angle, and that the corresponding angle B or C of the tooth 1*b*' or 2*b*', or 1*c*' or 2*c*' of the control roller 1*b* or 2*b*, or 1*c* or 2*c* is substantially equal to or larger than 30 degrees. These angles A, B and C are found to be varied with the variations in the angles or inclination $\alpha$, $\beta$ and $\gamma$ and the height $l$ of the respective teeth as well as in the relative position of the selected tooth to the sliver 6 and the distance between the centers of the paired control rollers. In one Example experimented by us, the angles A, B and C took the respective values of 97°, 80° and 80° under the experimental condition that the distance between the centers of the paired control rollers was 61 mm, the edge diameter of the control rollers 65 mm, the diameter of the dedendum circle 55 mm, and the angles $\alpha$, $\beta$ and $\gamma$ 40°, 30° and 30°, respectively.

Since the tooth structure according to the present invention has such construction as has been described in the above, the angle $\alpha$ of inclination of the teeth 1a' or 2*a*' and 1*a*'' or 2*a*'' can be preset at an acceptably low value. As a result, even when the tooth 1*a*' or 2*a*' is about, in operation, to leave the sliver 6, it will neither seize nor carry back the fiber of the sliver in the least. Moreover, since the macroscopic velocity of the sliver 6 at the position of the paired control rollers 1*a* and 2*a* can be made several times larger than the circumferential velocity of the teeth by the high-speed drawing action of the nip roller 15, and since the teeth 1*a*' and 2*a*', or 1*a*'' and 2*a*'' having a steep inclination at their front faces will hardly apply an excessive vertical pressure to the sliver when they go into the sliver, an undesirable drafting resistance will never be produced. Since, on the other hand, the angles $\beta$ and $\gamma$ of inclination of the teeth 1*b*' and 1*c*' are preset at relatively small values although the macroscopic velocity of the sliver in the vicinity of the control rollers 1b and 1c is made substantially the same as the circumferential velocity of the teeth, the angles B and C can take relatively large values when the teeth go into the sliver 6, so that the sliver can be made free from being vertically pressed, thus establishing no excessive drafting resistance. When the teeth 1*b*' and 1*c*' are about to leave the sliver 6 with the above angles B' and C', there may be a fear that they seize and carry back the fiber of the sliver because the resultant angles B and C between their front faces and the sliver are relatively small. This fear can be completely eliminated by the fact that the paired control rollers have their teeth intersected in the cascade direction or in the proceeding direction of the sliver and that the adjacent rollers 1a and 1*b*, 1*b* and 1*c*, 2*a* and 2*b*, and 2*b* and 2*c* are rotated in the opposite directions at their intersecting positions. Thus, the fiber, which might otherwise be seized and carried back by the tooth 1b or 1*c*', can be taken up and returned to the main flow of the sliver by the action of the tooth 1a or 1*b*', thus eliminating the undesired seizure.

As has been discussed hereinbefore, the tooth structure according to the present invention makes the best use of the fact that the macroscopic velocity of the sliver is different place by place at the control rollers, and can eliminate the undersirable phenomenon of seizure and and the excessive drafting resistance by affording the most suitable inclination for the position under consideration to the teeth of the control rollers. Although the tooth structure of the invention can enjoy the above prominent advantage, it will never invite a material increase in the production cost of the rotary drafting apparatus.

What is claimed is:

1. A rotary drafting apparatus for use in a spinning machine, including a pair of back rollers coactively rotatable for guiding therethrough sliver to be drafted, a pair of front rollers coactively rotatable for drafting the guided sliver, and plural pairs of control rollers interposed in cascade between said back rollers and said front rollers and each formed on its circumference integrally with a multiplicity of teeth coactively combing the guided sliver when the latter is passed therethrough, the improvement wherein the foremost pair of control rollers positioned closest to said front rollers have such a tooth structure that the angle defined between the tooth face of the leading side and a tangent taken toward the trailing side from the leading edge of the tooth to the deddendum circle of each of the control rollers, is preset at a value of at least 90°, and that the angle between the tooth face of the trailing side and a line dividing the leading edge of said tooth and the center of said control rollers, is preset at a value of up to 20°, and wherein the control rollers of the remaining pairs have such a tooth structure that the angle defined between the tooth face of the leading side and a tangent taken toward the trailing side from the leading edge of the tooth to the deddendum circle of each of the control rollers is preset at a valve of less than 80°.

* * * * *